US005097198A

United States Patent [19]

Holmdahl

[11] Patent Number: 5,097,198

[45] Date of Patent: Mar. 17, 1992

[54] VARIABLE POWER SUPPLY WITH PREDETERMINED TEMPERATURE COEFFICIENT

[75] Inventor: Todd E. Holmdahl, Bothell, Wash.

[73] Assignee: John Fluke Mfg. Co., Inc., Everett, Wash.

[21] Appl. No.: 666,250

[22] Filed: Mar. 8, 1991

[51] Int. Cl.[5] ..... G05F 1/567

[52] U.S. Cl. ..... 323/280; 323/907

[58] Field of Search ..... 323/234, 265, 273, 274, 323/280, 304, 311, 907

[56] References Cited

U.S. PATENT DOCUMENTS

| | | | |
|---|---|---|---|
| 3,546,564 | 12/1970 | Denny | 323/280 |
| 3,826,969 | 7/1974 | Eichelberger et al. | 323/280 |
| 3,864,623 | 2/1975 | Luce | 323/280 |
| 3,947,704 | 3/1976 | Blauschild | 323/280 |
| 3,959,717 | 5/1976 | Pitel | 323/280 |
| 4,110,677 | 8/1978 | Boronkay et al. | 323/280 |
| 4,236,064 | 11/1980 | Aiba | 323/907 |
| 4,302,726 | 11/1981 | Shobbrook | 323/280 |
| 4,313,083 | 1/1982 | Gilbert et al. | 323/907 |
| 4,714,872 | 12/1987 | Traa | 323/907 |
| 4,795,961 | 1/1989 | Neidorff | 323/907 |

*Primary Examiner*—Jeffrey Sterrett
*Attorney, Agent, or Firm*—Richard A. Koske

[57] ABSTRACT

A power supply having an amplifier connected to first and second feedback circuits is provided in which the nominal output of the power supply is a function of the first and second feedback circuits and the temperature coefficient of the power supply is also a function of the first and second feedback circuits. The first feedback circuit includes a voltage divider and a first voltage source and the second feedback circuit includes a second voltage source. The nominal output of the power supply and the temperature coefficient of the power supply are functions of the first and second voltage sources and the voltage divider.

7 Claims, 2 Drawing Sheets

VARIABLE POWER SUPPLY WITH PREDETERMINED TEMPERATURE COEFFICIENT

BACKGROUND OF THE INVENTION

The present invention relates generally to power supplies, and more particularly, to power supplies whose performance is responsive to the operating temperature of the power supplies.

A power supply is basically a voltage source that provides an input voltage to a particular circuit, device or component (hereinafter referred to collectively as "load"). In instances where the required input voltage of the load does not vary with changes in the operating temperature of the load, the power supply may be designed to provide a constant, temperature-independent output voltage. However, in situations where the required input voltage of a particular load varies with changes in operating temperature it is desirable that the performance of the power supply be temperature-dependant so that the output voltage of the power supply varies with the operating temperature of the power supply. Furthermore, in order to ensure the proper operation of the load over a range of temperatures, it may be highly desirable to have the output of the power supply match the input requirements of the load over a particular temperature range. To accomplish this, the output of the power supply and the input requirements of the load must vary by the same factor, or "temperature coefficient". It is the latter situation, namely, a power supply whose temperature coefficient is matched with the load's temperature coefficient, to which the present invention is directed.

A conventional power supply may have either a positive or negative temperature coefficient. The output voltage of a power supply with a positive temperature coefficient will increase as the operating temperature of the power supply increases and decrease as the operating temperature decreases. Conversely, the output voltage of a power supply with a negative temperature coefficient will decrease as the operating temperature of the power supply increases and increase as the operating temperature decreases.

The prior art contains several examples of power supplies that are designed to have temperature coefficients matched to the loads they supply. An example of one such power supply has one or more diodes stacked on a precise and substantially temperature independent voltage, such as a buffered bandgap voltage source. Together the stacked diodes and bandgap voltage provide the nominal output voltage of the power supply, while the diodes provide the power supply with a negative temperature coefficient. Unfortunately, this design does not offer much flexibility in designing the actual temperature coefficient or output of the power supply. Rather, the power supply's temperature coefficient is limited to a multiple of the diode temperature coefficients and the nominal output voltage of the power supply is limited to a combination of the bandgap voltage and the voltage across the stacked diodes. A second type of power supply found in the prior art includes a shunt regulator and a temperature compensation circuit. The shunt regulator provides the nominal output voltage of the power supply while the temperature compensation circuit provides the desired temperature coefficient. While this type of power supply provides design flexibility, the temperature compensation circuit is fairly complex and requires several components. A third type of power supply found in the prior art includes a positive temperature coefficient voltage source with feedback. Unfortunately, positive temperature coefficient sources are complicated and difficult to design. In addition, this type of power supply includes an additional resistor in the feedback path, which increases the number of components and, thereby, increases the manufacturing costs of the power supply.

Accordingly, there is a need for a power supply that requires few components and offers considerable design flexibility in selecting particular output voltages and temperature coefficients. The present invention is a power supply designed to achieve these results.

SUMMARY OF THE INVENTION

In accordance with the present invention, a power supply having a nominal output voltage and a predetermined temperature coefficient is provided. The power supply includes an amplifier, a first feedback circuit connected between the output of the amplifier and a first input of the amplifier, and a second feedback circuit connected between the output of the amplifier and a second input of the amplifier. The first and second feedback circuits operate with the amplifier to cause the power supply to produce the nominal output voltage and to cause the power supply to have the predetermined temperature coefficient.

In accordance with further aspects of the present invention, the first feedback circuit includes a voltage divider connected to a first voltage source and the second feedback circuit includes a second voltage source. The nominal output voltage and the predetermined temperature coefficient of the power supply are functions of the first and second voltage sources and the voltage divider.

As will be appreciated from the foregoing summary, the present invention provides a simple power supply whose nominal output voltage and predetermined temperature coefficient are determined by feedback circuits of the power supply.

BRIEF DESCRIPTION OF THE DRAWINGS

The foregoing and other advantages of this invention will become more readily appreciated as the same becomes better understood by reference to the following detailed description taken in conjunction with the accompanying drawings, wherein.

DETAILED DESCRIPTION OF THE PREFERRED EMBODIMENT

Figure 1:
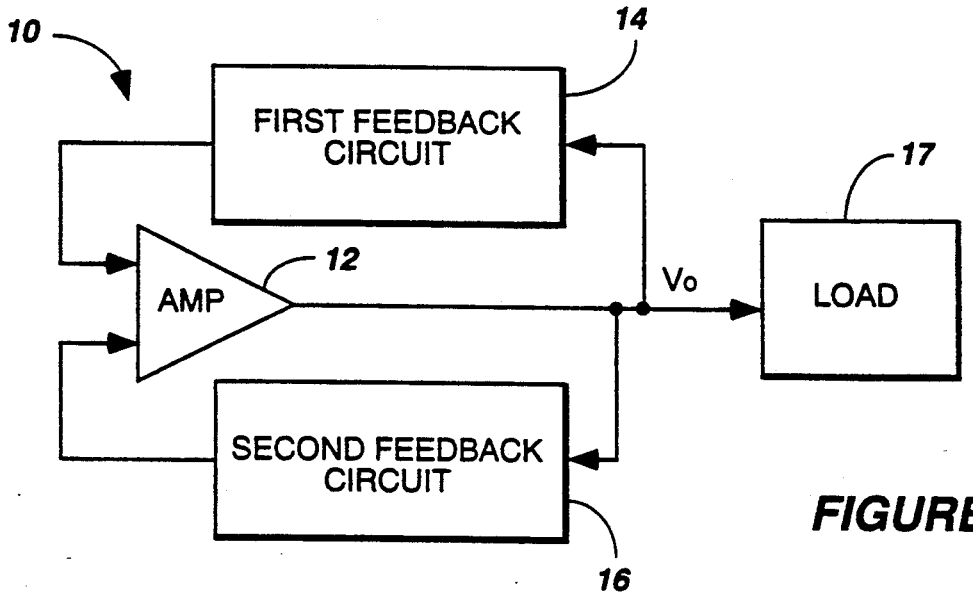
FIG. 1 is a block diagram depicting the broad functional features of a power supply formed in accordance with the present invention.

FIG. 1 illustrates, in simplified block diagram form, a power supply 10 in accordance with the present invention comprising an amplifier 12, a first feedback circuit 14, and a second feedback circuit 16. The power supply produces an output voltage, $V_0$, that is temperature dependant. That is, the $V_0$ output has a nominal value when the power supply 10 operates at a particular (i.e., rated) temperature and the value of the $V_0$ output is different than the nominal value when the power supply 10 is operating at a temperature other than the rated temperature. The factor by which $V_0$ varies as a result of changes in power supply operating temperature is referred to herein as the "temperature coefficient" of the power supply 10.

As further depicted in FIG. 1, the $V_0$ output of power supply 10 is applied to a load 17. Load 17 may be, for example, any component, circuit or device and does not form a part of the present invention but is illustrated and discussed herein to permit a better understanding of the power supply 10. For purposes of discussion, it is assumed that the input requirements of load 17 vary with changes in the operating temperature of the load 17. That is, as with the power supply 10, load 17 has it's own temperature coefficient. As is well known in the field of electronics, it is desirable to match the temperature coefficients of the power supply 10 and the load 17 so that the output of the power supply 10 changes to meet the changing input requirements of the load 17. For example, if load 17 is a liquid crystal display (LCD) it will most likely have a negative temperature coefficient, which means that the input voltage requirements of the LCD decrease as the operating temperature of the LCD increases. On the other hand, the required input voltage of the LCD increases as its operating temperature decreases. Accordingly, in the above example, the temperature coefficient of the power supply must be the same negative temperature coefficient of the LCD in order to assure proper performance of the LCD.

As will become better understood from the following discussion, the first and second feedback circuits 14 and 16 cause the power supply 12 to produce a nominal value of the $V_0$ output at the nominal, or rated, operating temperature of the power supply 10. As will also become better understood, the first and second feedback circuits 14 and 16 also cause the power supply 10 to have a predetermined temperature coefficient.

Figure 2:
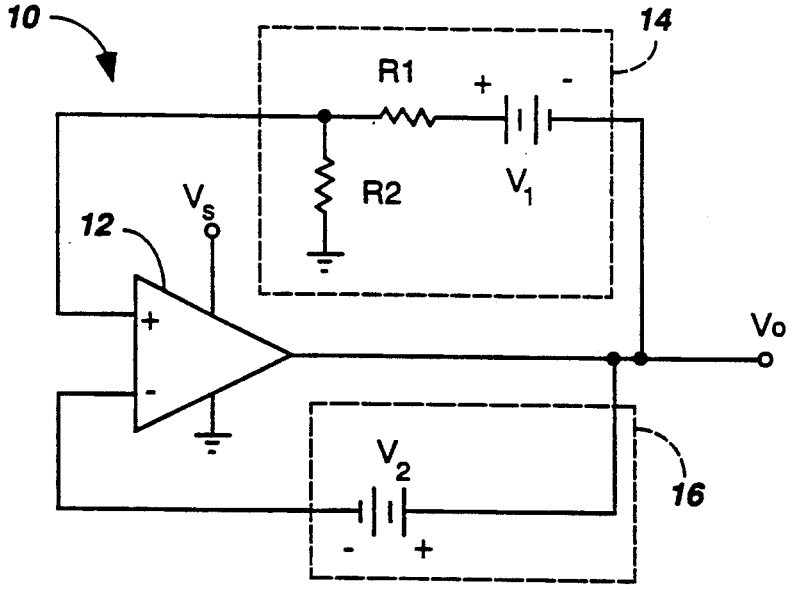
FIG. 2 is a simplified schematic diagram of a preferred embodiment of the power supply depicted in FIG. 1.

Turning next to FIG. 2, there is illustrated a simplified schematic diagram of a preferred embodiment of the power supply 10. In the preferred embodiment of power supply 10, amplifier 12 is an operational amplifier and the first feedback circuit 14 provides positive feedback and the second feedback circuit 16 provides negative feedback. As illustrated in FIG. 2, the operational amplifier 12 has power inputs connected to a supply bus, denoted $V_S$, and to ground. Alternatively, the grounded power input of amplifier 12 could be connected to another supply bus, such as a negative voltage supply bus, for example.

The first feedback circuit 14 is connected between the output and the noninverting signal input of amplifier 12 and comprises a voltage source, designated $V_1$, and a voltage divider formed by a pair of resistors, designated R1 and R2. The $V_1$ source is represented schematically as a battery having its anode connected to the output of the amplifier 12 and its cathode connected to one end of R1. The other end of R1 is connected to R2 and the noninverting input of amplifier 12. The other end of R2 is connected to ground. The second feedback circuit 16 is connected between the output and the inverting signal input of amplifier 12 and comprises a voltage source, designated $V_2$, shown figuratively as a battery having its anode connected to the inverting input of amplifier 12 and its cathode connected to the output of amplifier 12.

The first voltage source, $V_1$, has a temperature coefficient, designated $T_1$, and the second voltage source, $V_2$, has a temperature coefficient, designated $T_2$. Similarly, R1 and R2 also have temperature coefficients. In accordance with the preferred embodiment of the present invention, the values of $T_1$ and $T_2$ may be different while the temperature coefficients of R1 and R2 are assumed to be the same.

As discussed above, the first and second feedback circuits 14 and 16 determine the value of amplifier output, $V_0$. The output of the power supply 10 may be computed according to the following equation:

$$V_0=[(R2/R1)*V_1]+[V_2*(1+(R2/R1))]. \quad \text{Eq. 1}$$

As was also discussed above, the first and second feedback circuits 14 and 16 also determine the temperature coefficient of the power supply 10, which can be computed according to the following equation:

$$T_p=T_1*(R2/R1)+T_2*[1+(R2/R1)], \quad \text{Eq. 2}$$

where $T_p$ is the temperature coefficient of the power supply 10.

As can be seen from Eq.'s 1 and 2, the output voltage ($V_0$) and the temperature coefficient ($T_p$) of the power supply 10 can be precisely determined by selecting appropriate values for R1, R2, $V_1$ and $V_2$. Thus, the values of $V_0$ and $T_p$ are not determined solely by the values of $V_1$ and $V_2$. Rather, $V_0$ and $T_p$ are functions of $V_1$, $V_2$, R1 and R2, which provides more flexibility in designing a power supply with a predetermined output and temperature coefficient.

Figure 3:
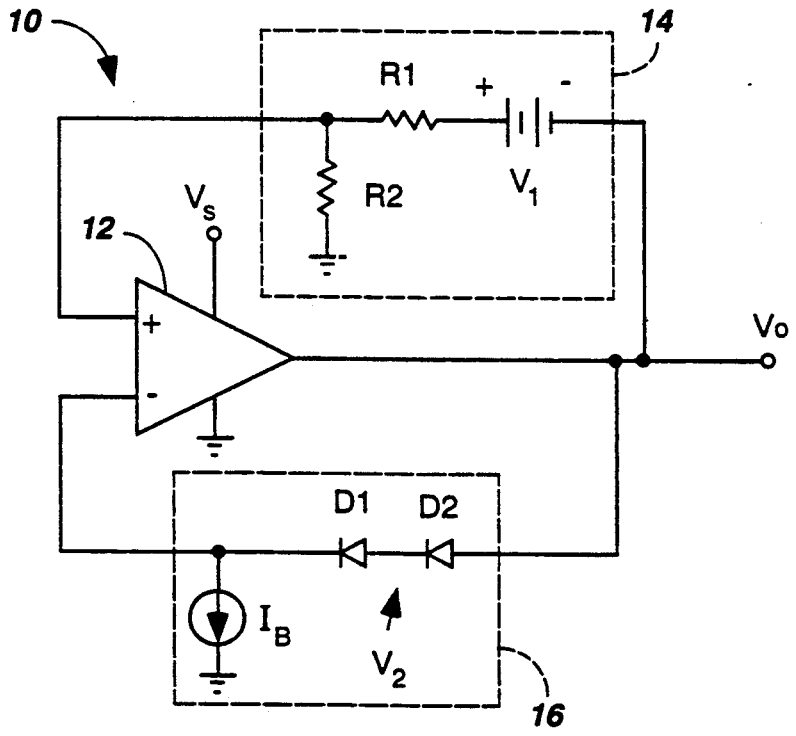
FIG. 3 is a schematic diagram of a working prototype of the preferred embodiment of the power supply depicted in FIG. 2.

Turning next to FIG. 3, there is depicted a commercial prototype of the preferred embodiment of the power supply 10 discussed above and depicted in FIG. 2. In this prototype, $V_1$ is a stable and substantially temperature-independent voltage source, such as a bandgap voltage source. Because bandgap voltage sources are commonly used to provide precise and stable voltages and are well known to persons having ordinary skill in the electronics field, they are not discussed herein in further detail. The $V_2$ source in FIG. 3 is a temperature-dependant voltage source formed by a pair of diodes, designated D1 and D2 and a constant current source, designated $I_B$.

The D1 and D2 diodes are connected in series with the anode of D2 connected to the output of amplifier 12 and with the cathode of D1 connected to the noninverting input of amplifier 12 and one end of current source $I_B$. The other end of $I_B$ is connected to ground. D1 and D2 are biased by $I_B$. As is well known, diodes possess negative temperature coefficients. For example, a typical temperature coefficient for a diode is: $-2$ mv/°C. Thus, the temperature-dependant voltage source, $V_2$, formed by D1 and D2 in FIG. 3 has a negative temperature coefficient ($T_2$) of $-4$ mv/°C. It is to be appreciated, however, that other values for $T_2$ would also work in the power supply 10 of FIG. 3.

By selecting temperature-dependant voltage source, $V_2$, so that it is zero ($V_2=0$ volts) at the nominal, or rated, operating temperature of the power supply 10, Eq. 2 can be simplified and the nominal output of the power supply 10 can be computed according to the following equation:

$$V_{NO}=(R2/R1)*V_1, \quad \text{Eq. 3}$$

where $V_{NO}$ represents the nominal $V_0$ output at the nominal operating temperature of the power supply 10.

Similarly, by selecting $V_1$ as a temperature-independent source, as noted above, $T_1$ has no impact on the power supply 10 and Eq. 2 can be simplified and the $T_p$ temperature coefficient of the power supply 10 may be computed according to the following equation:

$$T_p = T_2 * [1 + (R2/R1)]. \quad \text{Eq. 4}$$

Thus the general equations for output voltage (Eq. 1) and temperature coefficient (Eq. 2) can be simplified to Eq.'s 3 and 4, respectively, when $V_1$ is properly selected to be a temperature-independent source and $V_2$ is properly selected as a temperature-dependant source. By so selecting $V_1$ and $V_2$, $V_{NO}$ is determined by $V_1$, $R_1$ and $R_2$, and $T_p$ is determined by $V_2$, $R_1$ and $R_2$.

In summary, the resistors forming the voltage divider in the first feedback circuit and the voltage sources in the first and second feedback circuits offer a designer a great degree of flexibility in designing a power supply having the desired nominal output and temperature coefficient. In addition, manufacturing costs of a power supply formed in accordance with the present invention are low because the power supply is simple and requires few components.

While a preferred embodiment of the present invention has been illustrated and described herein, it should be appreciated that various changes can be made therein without departing from the spirit and scope of the invention. For example, another substantially temperature-independent voltage source, such as a trimmed, temperature compensated zener device may be used in place of a bandgap voltage source. Similarly, a current source in conjunction with resistors having defined temperature coefficients could be use instead of diodes for the temperature-dependent voltage source. Consequently, the invention can be practiced otherwise than as specifically described herein.

I claim:

1. A variable power supply comprising:

(a) an amplifier having first and second inputs and an output;

(b) a first feedback circuit having a temperature-independent voltage source coupled between the output of the amplifier and the first input of the amplifier; and (c) a second feedback circuit having a temperature-dependent voltage source coupled between the output of the amplifier and the second input of the amplifier, wherein said first and second feedback circuits and said amplifier cause the power supply to have a predetermined temperature coefficient and further cause the power supply to produce a variable output voltage that is a function of said predetermined temperature coefficient.

2. The power supply according to claim 1, wherein said first feedback circuit includes a voltage divider connected between said temperature-independent voltage source and said first input of said amplifier, such that said variable output voltage of the power supply is a function of said voltage divider and said temperature-independent voltage source and wherein said predetermined temperature coefficient of the power supply is a function of said voltage divider and said temperature-dependent voltage source.

3. The variable power supply according to claim 2, wherein said voltage divider includes a first resistor and a second resistor, said first and second resistors having substantially the same temperature coefficients.

4. The variable power supply according to claim 2, wherein said temperature-independent voltage source is a bandgap voltage source.

5. The variable power supply according to claim 2, wherein said amplifier is an operational amplifier and said first input is a noninverting input and said second input is an inverting input, such that said first feedback circuit is a positive feedback circuit and said second feedback circuit is a negative feedback circuit.

6. The variable power supply according to claim 2, wherein said temperature-dependent voltage source includes at least one diode.

7. The variable power supply according to claim 2, wherein said temperature-dependent voltage source includes at least two diodes connected in series.

* * * * *